US008349282B2

(12) United States Patent
Zwahr

(10) Patent No.: US 8,349,282 B2
(45) Date of Patent: Jan. 8, 2013

(54) TREATMENT OF FLY ASH

(75) Inventor: Heiner Zwahr, Reinbek (DE)

(73) Assignee: Green Conversion Systems, LLC, Rye, NY (US)

( * ) Notice: Subject to any disclaimer, the term of this patent is extended or adjusted under 35 U.S.C. 154(b) by 19 days.

(21) Appl. No.: 13/082,759

(22) Filed: Apr. 8, 2011

(65) Prior Publication Data

US 2011/0251449 A1 Oct. 13, 2011

(30) Foreign Application Priority Data

Apr. 12, 2010 (EP) ..... 10159642

(51) Int. Cl.
*A62D 3/40* (2007.01)
*B01D 53/64* (2006.01)
*F23G 5/00* (2006.01)

(52) U.S. Cl. ..... 423/210; 423/215.5; 110/255; 110/259; 110/342; 110/344; 106/705

(58) Field of Classification Search ..... 423/215.5, 423/210; 110/255, 259, 342, 344; 106/705
See application file for complete search history.

(56) References Cited

U.S. PATENT DOCUMENTS

| | | | | |
|---|---|---|---|---|
| 5,925,165 | A * | 7/1999 | Pflugl et al. | 75/10.41 |
| 6,375,908 | B1 * | 4/2002 | Kaszas-Savos et al. | 423/210 |
| 2003/0183139 | A1 * | 10/2003 | Martin et al. | 110/346 |

FOREIGN PATENT DOCUMENTS

| | | |
|---|---|---|
| DE | 4107200 | 9/1992 |
| DE | 4132770 | 4/1993 |
| DE | 4135368 | 7/1993 |
| DE | 10 2007 057 106 | 5/2009 |
| EP | 0673988 | 9/1995 |
| WO | 01/54800 | 8/2001 |

OTHER PUBLICATIONS

European Commission, Integrated Pollution, Prevention and Control, Reference Document on Best Available Techniques for the Waste Treatments Industries, Aug. 2006; Chapter 2.3.3.15 Bottom Ash Treatment, pp. 76 and 77.

European Commission, Integrated Pollution Prevention and Control, Reference Document on the Best Available Techniques for Waste Incineration, Aug. 2006; Chapter 4.6 Treatment Techniques for Solid Residues including the subchapters 4.6.1 to 4.6.8, pp. 397-410 and Chapter 5 Best Available Techniques with subchapters 5.1-5.3, pp. 431-451.

* cited by examiner

*Primary Examiner* — Timothy Vanoy
(74) *Attorney, Agent, or Firm* — Rankin, Hill & Clark LLP

(57) ABSTRACT

A method for the treatment of fly ash obtained from an incineration process of a waste incineration plant, in particular for municipal solid waste, whereby fly ash is separated from the incineration process. Furthermore, a method for the operation of a waste incineration plant, in particular for municipal solid waste or the like. The process for the treatment of fly ash is further characterized in that metals and/or metal containing compounds, in particular heavy metals and/or heavy metal containing compounds, are separated from the fly ash, which is separated from the combustion process and preferably non-fractioned, in a separation step and subsequently the fly ash reduced by the metals and/or metal containing compounds is, preferably dosed, mixed with or added to the waste to be incinerated so that the mineral parts of the fly ash, reduced by its metals and/or metal containing compounds, are returned to the combustion process.

14 Claims, 2 Drawing Sheets

TREATMENT OF FLY ASH

BACKGROUND OF THE INVENTION

1. Field of the Invention

The invention relates to a method for the treatment of fly ash from a combustion process in a waste incineration plant, of in particular domestic waste, whereby fly ash is separated from the combustion process. Furthermore, the invention relates to a process for the operation of a waste incineration plant, in particular for the incineration of municipal solid waste or the like.

2. Description of Related Art

In waste incineration facilities for municipal solid waste bottom ash (grate dumpings and grate riddlings), boiler fly ash in the drafts of the boiler and filter fly ash in the flue gas treatment accrue as solid residues. These residues of the combustion process contain materials that can impair their recyclability. These contaminants can, for example, be unburned carbon compounds, soluble metals and their compounds, halogenated hydrocarbons such as dioxins, furans, and their precursors.

The best available techniques for waste incineration facilities are, for example, documented in the "Reference Document on the Best Available Techniques for Waste Incineration" by the European Commission, General Directorate, Joint Research Centre (JRC), Institute for Prospective Technological Studies, published August 2006.

Furthermore the treatment of residues of waste incineration, for example the treatment of bottom ash/waste incineration bottom ash with the best available techniques today is described in the "Reference Document on the best Available Techniques for Waste Treatment Industries", published by the European Commission, August 2006.

In addition, DE 10 2007 057 106 A1 discloses a process for the production of compactable granule of bottom ash as a product of waste incineration.

In modern waste incineration facilities, the bottom ash after mechanical treatment can be applied as a waste for re-use to replace mineral wastes preferably in road construction as drainage or sub base as long as the environmental and construction requirements are fulfilled. For example, ferrous metals and non-ferrous metals such as aluminium or copper, recovered from the waste incineration process are recycled in steel works or metallurgical plants respectively.

In the current waste incineration processes there is typically also produced waste which is dangerous for the environment, which has to be disposed in licensed landfills, wherein this waste for the landfills is obtained as mixture of fly ashes and residues of the exhaust gas purification in the amount of about 6 weight % to 8 weight % of the waste treated. Hereby, the amount of the hazardous waste to be disposed depends on the type of flue gas treatment and the emission limits for fly ashes, in particular boiler fly ash and filter fly ash.

Furthermore, another important aspect of thermal waste treatment respectively incineration of municipal waste or residential waste or the like in existing waste incineration facilities is the recovery of usable energy to improve the energy balance and in addition to reduce climate relevant gases besides the recovery of re-usable materials. The recovery of re-usable byproducts reduces (marginally) the effectiveness of the production of usable energy by thermal waste treatment.

Starting from this state of the art, the object of the invention is to reduce the amount of residues produced in the process of thermal waste treatment that have to be disposed in landfills, wherein it should be possible to gain an increased rate of re-usable materials.

BRIEF SUMMARY OF THE INVENTION

This object is solved by a method for the treatment of fly ash from a waste incineration process in a waste incineration plant, in particular of municipal solid waste, whereby fly ash is separated from a combustion process, characterized in that metals and/or metal containing compounds, in particular heavy metals and/or compounds containing heavy metals, are separated from the fly ash, which is separated from the combustion process and preferably non-fractioned, in a separation step and subsequently the fly ash, reduced by the metals and/or metal containing compounds, is, preferably dosed, mixed with or added to the waste to be incinerated in the waste incineration process so that the mineral fractions of the fly ash, reduced by metals and/or metal containing compounds, are returned to the combustion process.

The invention is based on the idea that metals are recovered for re-use from fly ashes or fly dusts, which are separated from the flue gas from the combustion process as boiler fly ashes and/or filter fly ashes in the boilers and filters, e.g. electrostatic precipitators and/or fabric filters, in the waste incineration plants, whereby the heavy metals are recovered in a predetermined technical grade quality and the fly ash, reduced by the metals or metals containing compounds, is recycled into the combustion process to bind the mineral fractions in the fly ash respectively the boiler dust and/or in the filter fly ashes into the bottom ash produced in the combustion process, thereby the mineral fractions of the waste incineration bottom ash are enriched. For the recovery of the heavy metals, heavy metals are recovered as carbonates (by means of ammonia alkaline leaching) or hydroxides (by means of hydrochloric acid leaching) in technical grade purity sufficient for the direct processing in corresponding metallurgical plants. Furthermore, a high rate of recovered metals, in particular heavy metals, as re-usable (by-) products is achieved.

In particular, by means of the steps according to the invention, the amount of waste that has to be disposed in adequate hazardous landfills, which is or will be produced directly or indirectly during the combustion process, is reduced significantly to less than 2.5 weight %, in particular by (about) 1.5 weight % or more of the mass of the waste to be incinerated—according to the mineral content of the fly ash.

The mineral fractions of the fly ash, which are reduced according to the invention by heavy metals and/or heavy metals containing compounds, contain—in comparison to the fly ash coming from the combustion process—higher portions, respectively, fractions of silicon (Si), iron (Fe), aluminium (Al), calcium (Ca), magnesium (Mg), sodium (Na), and/or potassium (K) as well as, in case, sulphur (S) and/or phosphor (Ph), whereby the mineral components are or can be present as the mineral forming phases.

Especially, the residues resulting from the flue gas treatment of a waste incineration plant contain absorption materials, salts, minerals, heavy metals as well as organic compounds such as e.g. dioxins and/or furans or the like.

By the execution of the process steps according to the invention heavy metals in the fly ash, for example in filter fly ash, are reduced and recovered for re-use, whereby moreover the fly ashes, reduced by their metals respectively heavy metals, are recycled into the combustion process by mixing with or adding, dosed to the waste to be incinerated.

Especially in the incineration process of waste incineration plants or facilities, residential or municipal waste is burned wherein municipal waste for example is post-recycling waste, organic waste, waste paper, glass, metal containers and/or plastic packaging respectively light packaging.

According to the invention the concentration of highly volatile metals such as e.g. arsenic, antimony, mercury, copper, lead, tin and zinc are reduced in the treated fly ashes, in particular filter fly ashes and/or boiler fly ashes, by at least 50%, preferably more than 70%, whereby it is possible to return the fly ash, reduced by heavy metal or metal, with its increased mineral fractions to the combustion process. Hereby the mineral fractions will be incorporated in newly formed bottom ash of the waste incineration process without the risk of raising the concentration of the metals respectively the heavy metals in the incineration gas to (not permissible) higher concentrations. Therefore, the concentration of metals or heavy metals does not result in a concentration which may be higher than permissible limit values. The contamination of the bottom ash will not be changed either.

In a preferred embodiment of the method, it is furthermore envisaged, that the fly ash, reduced by metals and/or metal containing compounds, and in particular dewatered (dried), is compacted, preferably pelleted, in predetermined quantities, preferably in a pelleting device. Thereby, it is possible to compact the fly ash from the separation step, reduced by metals and/or metal containing compounds, in defined quantities, in particular after a drying step, whereby the fly ash, reduced by metals and/or metal containing compounds, is easy to handle and/or to store it in an intermediate storage and is provided for the addition to the waste to be incinerated. Hereby, according to the method, a decoupling of the combustion process of waste and the separation step respectively the separation process with the separation, respectively, extraction of metals and/or metal containing compounds out of fly ashes or the filter dusts and/or the filter fly ashes is possible. In particular, the pelleting or the compacting of the fly ash, reduced by metals, into pellets or the like is especially suitable for the handling of the fly ash, reduced by metals.

Furthermore, it is advantageous for the embodiment of the method that the compacted, preferably pelleted, fly ash, reduced by its metals and/or metal containing compounds, is stored as fly ash residue in an intermediate reservoir in the form of pellets, whereby in particular the, preferably intermediately stored, fly ash residue from the intermediate reservoir is mixed with or added to the waste to be incinerated. Herewith, the addition, respectively, mixing of the fly ash residue will be carried out depending on the amount of waste to be incinerated. Thus, it is possible to supply dosed, the addition respectively the mixing of the fly ash with increased mineral fraction to the amount of waste to be burned.

Moreover, in an embodiment it is preferred, that the, preferably non-fractioned, fly ash in the separation step is treated by a wet chemical leaching process, in particular leaching extraction, so that in particular the fly ash is reduced by metals and/or metal containing compounds and/or earth alkaline metals, whereby as a product of the leaching process, respectively, the extraction process recyclable metals, in particular heavy metals and/or compounds containing heavy metals, are obtained.

Hereby, in the separation step the fly ash respectively the filter fly ash as well as boiler fly ash will be subject to a hydro metallurgical process, which is integrated in the treatment of the fly ash. In the wet-chemical leaching process the, in particular non-fractioned, fly ash will be treated chemically in a leaching device by the use of appropriate leaching media such as e.g. ammonia or acids, whereby in an additional separating step, metals and/or metal containing compounds will be washed out and thus separated out of the fly ash in the extraction device.

Hereby, the operating conditions of the process are adjusted accordingly to the chemical properties of the metals respectively heavy metals to be obtained. Thereby e.g. in a wet chemical process, easily up to moderately soluble salts containing metals are washed out accordingly by applying a leaching solution. In a wet chemical leaching process by the use of acids, in particular hydrochloric acid, the highly volatile heavy metals will be washed out depending on their solubility and will be incorporated accordingly in a matrix for recovery.

Through the leaching process the concentration of the (highly volatile) heavy metals contained in the fly ash will be reduced by at least or more than 50%, in particular more than 70%, whereby in particular the fly ash will be subjected to an ammonia alkaline leaching process and/or a leaching process using hydrochloric acid. In a further embodiment, it is also possible to combine the ammonia alkaline leaching process with leaching by hydrochloric acid in order to achieve an increased recovery rate of re-usable heavy metals and thereby to optimize the consumption of leaching liquids.

Preferably the heavy metals or heavy metal containing compounds will be reduced in the separation step by the wet chemical leaching process by at least or by more than 50%, preferably by more than 70% in content, respectively, in their concentration. Thereby it is possible that the thermal waste treatment will be achieved at lower emissions and a higher material recovery rate through the recovery of heavy metals, respectively, heavy metal containing compounds. It is especially possible, that in the thermal waste treatment, besides ferrous and non-ferrous metals such as copper, aluminium, and stainless steel, heavy metals, respectively, heavy metal containing compounds are recovered at low emissions.

Moreover, it is advantageous in the embodiment of the method that the metals or heavy metal containing compounds contained in the fly ash are extracted after leaching by means of a leaching solvent in an extraction step and/or, in particular after the extraction step in an extraction device, are precipitated, or are obtained in a solvent extraction process. Thereby the leaching process and the extraction processes will be, respectively are, decoupled. The separation of the heavy metals out of the (leached) fly ash will be done in case of the ammonia alkaline leaching process by precipitation, and in case of leaching with hydrochloric acid by a solvent extraction process.

For example, in case of ammonia alkaline leaching, metals respectively heavy metals forming stable metal-amine-complexes will be solved by ammonia ($NH_3$), whereby the metals, in particular heavy metals, will be present as oxides or in the metallic form. Herewith e.g. the filter fly ash separated in a fabric filter in a first leaching stage will be leached with a solvent consisting, for example, of ammonia carbonate and hydrous ammonia, and for example cadmium, copper, nickel, and zinc are solved. Thereby besides the mentioned heavy metals, alkaline metals as well as earth alkaline metals will be solved.

Furthermore in the leaching process, a residue remains containing water insoluble, silicated material. Metals, which do not form metal-amine-complexes such as iron, chrome or lead, remain unsolved in the leaching residue. In a subsequent step the remaining residue is separated from the leaching solvent, whereby the residue is washed and dried from the washing fluid. The resulting filtrate is conveyed afterwards to the metal separation in the extraction device, respectively, extraction step.

Beyond this, it is envisaged for a hydrochloric leaching to solve the metals out of the filter fly ash, whereby leaching of the filter fly ash is carried out with a hydrochloric medium, e.g. HCl (hydrochloric acid). Thereby, heavy metals such as e.g. mercury, cadmium, copper, nickel, and zinc as well as lead are solved. Subsequently, the leaching solvent is separated from the remaining residue, and the residue afterwards is washed and freed from the washing water. The obtained filtrate finally is subsequently subjected to a metal recovery process for the separation of e.g. lead, cadmium, iron, copper, and zinc.

Furthermore in a preferred embodiment of the method it is suggested that the, in particular mineral fractions containing, residue of the leaching process is returned to the combustion process, whereby the mineral fractions of the bottom ash is further increased.

Especially the fly ash is treated in the separation step by means of an ammonia alkaline leaching and/or by means of a hydrochloric leaching. In the ammonia alkaline leaching solvent, the precipitation of e.g. the carbonates of zinc, cadmium, or copper respectively other metal carbonates is carried out by thermally removing the ammonia, whereby in particular for example zinc is precipitated as a basic zinc carbonate. Hereby during the dissociation of the zinc amino complex ammonia is set free again. Especially, the ammonia alkaline leaching process is performed by applying a forced circulation evaporator.

Further, when separating cadmium, copper, zinc, and lead out of the leaching fluid the organic phase (extraction reagent or solvent) will be repeatedly intensively mixed with a filtered aqueous phase, whereby the metals, respectively heavy metals, will be extracted out of the leaching solvent. Moreover lead, cadmium, copper, and zinc are re-extracted out of the enriched organic phase.

In general it can be concluded that within a process of wet chemical treatment, respectively, wet chemical leaching fly ash is subjected to a solid/liquid separation and washing process, in which a leaching residue, preferably with mineral components, is separated from the fly ash. Consecutively the leaching solvent is filtered, whereby in the ammonia alkaline leaching the filtered solvent is evaporated. In the hydrochloric acid leaching process the metals respectively the heavy metals such as cadmium, lead, copper and such are recovered in the form of metal carbonates or metal hydroxides from the filtered solvent in a metal separation step by extraction. Subsequently the hydrochloric acid which is obtained during the metal separation is subjected to a crystallizing stage to recover alkaline metal chlorides. As an alternative, the hydrochloric acid leaching solvent can also be concentrated and jointly disposed with other brine solutions from the incineration process.

Within the scope of this invention, the wet chemical leaching and extraction process as a hydrometallurgical process is suited for the treatment of fly ashes. Hereby wet chemical leaching and extraction is a selective process for the separation, isolation and consecutive concentration of a valuable material respectively a heavy metal or heavy metals as well as, for example, of highly volatile (heavy) metals, which have been recovered from fly ashes of waste incineration facilities or combustion processes of municipal solid waste or the like by leaching and under the use of a (preferably organic) solvent.

Hereby, in the process step of extraction the aqueous solution, which contains the (heavy) metals to be recovered, is mixed with an organic solvent, which contains an appropriate reagent. The (heavy) metals containing valuable materials react with the reagent and thereby form a chemical compound, which can be solved easier in the organic solvent than in the aqueous solution. Thus, the heavy metals as valuable materials for recovery are transferred into the organic solvent.

Consecutively, the organic solvent is stripped with an aqueous solvent, whereby the solvent has a chemical composition in order to separate the chemical bond between the heavy metals as valuable materials and the reagent and to transfer the pure heavy metals (extraction) into another aqueous solvent. By adapting the fluid flows it is hereby possible, that the concentration of the heavy metals as valuable materials in the solvent is increased by a factor of 10 to 100 in comparison with the concentration of the heavy metals in the original aqueous solution. After the separation of the desired heavy metals from the organic solvent, the organic solvent can be reused for extraction, whereby the organic solvent is cleaned in an intermediate step.

As appropriate leaching agent for a wet chemical preparation of fly ash, respectively, filter fly ash ammonia and hydrochloric acid are suited, wherein both fluids are used in waste incineration facilities as operational materials at the flue gas treatment, for example for the reduction of nitrogen oxides, or at the water treatment, for example for the regeneration of ion exchangers, or are produced as a by-product (hydrochloric acid) from the flue gas treatment during the operation of a waste incineration plant.

Within the scope of the invention, it is possible to use a two-stage wet chemical leaching process by applying a combination of ammonia alkaline leaching and hydrochloric leaching in order to solve the relevant heavy metals for recovery and re-use out of the fly ashes or filter fly ashes optimally and to reduce the consumption of operational materials.

Furthermore through the design of the process it is, in particular, advantageous that the amount of residues resulting from the incineration process that has to be disposed can be reduced by (approximately) 1.5 weight % and less of the amount of waste incinerated according to the proportion of the mineral fraction of the fly ash. Thereby it is possible to obtain less than 1.5 weight %, preferably (less than or equal) 1.0 weight % of the amount of the waste incinerated as landfill waste or as waste to be disposed from the combustion process.

Furthermore, in this process boiler fly ash and/or filter fly ash from flue gases of waste incineration processes are subjected, in particular non-fractioned, as fly ash to the separation step.

A further solution of the object provides a method for the operation of a waste incineration plant, in particular for municipal solid waste or the like, whereby afore described process steps are performed. To avoid repetitions, reference is expressively made to the above description. According to the invention it is hereby advantageous that a facility or device for the treatment of fly ash is integrated into the waste incineration plant for domestic waste or the like so that by the use of the device for the treatment of the fly ash the above described process can be executed.

BRIEF DESCRIPTION OF THE DRAWINGS

The invention is described below in an exemplary manner, without restricting the general intent of the invention, based on exemplary embodiments in reference to the drawings, whereby we expressly refer to the schematic drawings with regard to the disclosure of all details according to the invention that are not explained in greater detail in the text. The drawings show in.

DETAILED DESCRIPTION OF THE INVENTION

In the following figures, the same or similar types of elements or respectively corresponding parts are provided with the same reference numbers in order to prevent the item from needing to be reintroduced.

Figure 1:
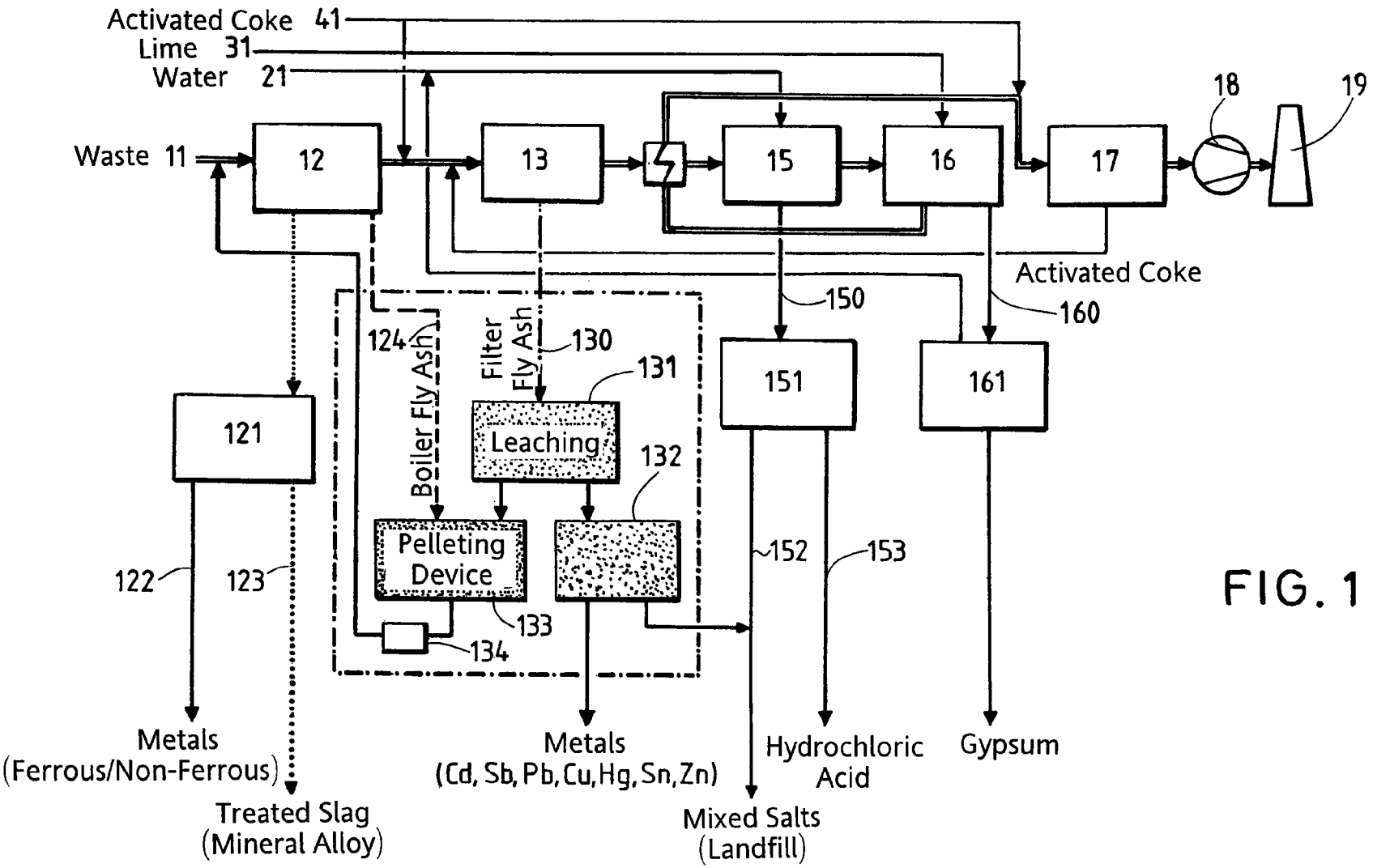
FIG. 1 a schematic process scheme of a waste incineration plant.

FIG. 1 shows schematically the process scheme of a waste incineration plant for the combustion of municipal solid waste or the like. Hereby collected waste 11 is conveyed into a combustion chamber 12 of a combustion boiler, whereby bottom ash 120, in particular crude bottom ash, is discharged via an extractor.

The combustion chamber 12, in which the waste 11, respectively, the municipal solid waste is incinerated, can be constructed as a steam generator, and the steam generator can be designed with multiple flues. Further boiler fly ash 124 is removed from the combustion chamber 12 via another discharge. Preferably boiler fly ash 124 is separated at temperatures >300° C., since heavy metals or their compounds have hardly or not at all condensed at these temperatures (>300° C.). Preferably 50% and more of the total amount of fly ash are separated at temperatures above 300° C.

The flue gas produced by the combustion of waste in the combustion chamber 12 is conveyed via another discharge into a filter device 13, whereby in this arrangement the filtering installation is designed as a bag house. Optionally, activated coke is injected into or mixed with the flue gas after the exit of the combustion chamber 12 in order to absorb dioxins, respectively, furans as well as heavy metals. Activated coke is either fed directly from the storage silo or is separated out of the flue gas in a down-stream filter device 17 to be conveyed from filter device 17 to the flue gas exiting the combustion chamber 12 downstream of the (first) filter device 13.

The fly ashes contained in the flue gas are separated by means of a bag house 13 and are discharged as filter fly ash from the bag house 13. Consecutively the flue gas from bag house filter 13 is conveyed to an HCl-scrubber (hydrochloric scrubber) 15 via a heat exchanger 14, so that acid flue gas components are separated in the, preferably multiple stage respectively two-stage, scrubber. In particular hydrochloric acid components 150 are separated in the HCl-scrubber 15, wherein the separated hydrochloric acid 150 or its components are further treated in a hydrochloric acid rectification device 151. Water 21 is fed into the HCl-scrubber 15 for the separation of hydrochloric acid 150 out of the flue gas.

In the hydrochloric acid rectification device 151 the hydrochloric acid 150 is rectified, whereby mixed salts and hydrochloric acid are discharged from the hydrochloric acid rectification device 151. Hereby, it is possible that the raw hydrochloric acid is concentrated to a technical grade hydrochloric acid 153 in the rectification device 151. The residues 152, obtained in the rectification device 151, can be concentrated to a solution that can be transported in tanker trucks or it can be dried by evaporation for disposal.

The flue gas, freed from acid in the HCl-scrubber 15, is consecutively conveyed to a sulphur-dioxide-scrubber 16 ($SO_2$-scrubber), wherein by feeding lime 31, respectively, quick lime as an absorbent a gypsum containing suspension 160 is produced out of sulphur dioxide and lime in the sulphur-dioxide-scrubber 16, which is separated via a discharge and is conveyed to a gypsum processing device 161 so that gypsum is produced as a product of the gypsum processing device 161. The residual water recovered during the gypsum treatment in the gypsum treatment device 161 is thereby returned to the supplied water 21 of the HCl-scrubber 15.

Furthermore the cleaned, i.e. deacidified, and cleaned from sulphur compounds, flue gas is conveyed from the sulphur dioxide scrubber 16 via the heat exchanger 14 to another filter device 17 comprising a bag house filter. Thereby activated coke 41 respectively hearth type furnace coke (HOK) is added to the flue gas prior to the entry into the filter device 17 whereby residues of heavy metals and dioxins, respectively, furans are bound. Finally a draft fan 18 delivers the flue gas to a stack 19, so that the flue gas, cleaned in the waste incineration plant, is emitted into the atmosphere.

As it can be seen in FIG. 1, the bottom ash 120, extracted from the combustion chamber 12, respectively, the steam generator, is conveyed to an, in particular mechanical, bottom ash treatment device 121, so that metals 122 and treated bottom ash 123 are provided from the bottom ash treatment device 121. The metals 122 comprise ferrous as well as non-ferrous metals. The treated bottom ash 123 is provided as a mixture of minerals for further processing and re-use.

Within the scope of the invention, it is possible that the bottom ash treatment device 121 is constructed externally and therefore separated from the combustion and treatment processes of the waste incineration plant and is, therefore, also operated externally.

Furthermore, within the scope of the invention it is also possible that the treated bottom ash 123 is subjected to a washing process as well as glass separation so that glass components from the treated bottom ash are provided for recovery. Further, within the scope of the invention, it is also possible that a, preferably dried, slag is obtained from the treated and washed bottom ash 123 for recycling.

The filter fly ash 130, extracted, respectively, recovered from the filter device 13, is conveyed to a leaching device 131 so that (heavy) metal containing components respectively (heavy) metals are separated from the filter fly ash 130 in the leaching device 131, whereby the metals as well as metal containing components are conveyed from the leaching device 131 to a metal extraction device 132, while the leached fly ash, reduced by its metals and/or heavy metals, is conveyed to a pelleting device 133.

Additionally boiler fly ash 121 as well from the combustion chamber 12, respectively, the steam generator are conveyed to the pelleting device 133, so that after drying of the filter fly ash in the pelleting device 133 the filter fly ash and boiler fly ash, which are reduced by metals, respectively heavy metals, are pelletized and conveyed into an intermediate reservoir 134, in which the pellets formed out of filter and boiler fly ash are (intermediately) stored. From the intermediate reservoir 134 as well as from the pelleting device 133 the pellets, consisting of boiler fly ash and filter fly ash, are conveyed to the waste 11.

In a further embodiment, it is possible that, for example in case of an external bottom ash treatment with a glass separation stage of the bottom ash of the pelleting device 133, slag, in particular dried slag, from the bottom ash treatment is conveyed to the filter fly ashes and boiler fly ashes to be pelletized, so that the pellets will consist of the fine particles of the bottom ash and parts of fly ash.

In the extraction device 132 metal hydrochlorides and/or metal chlorides of for example cadmium, antimony, lead, copper, mercury, tin, and zinc are recovered by carrying out stripping processes and precipitation process, while accrued earth alkaline metals are conveyed to the mixed salts 152 from the rectification device 151.

Figure 2:
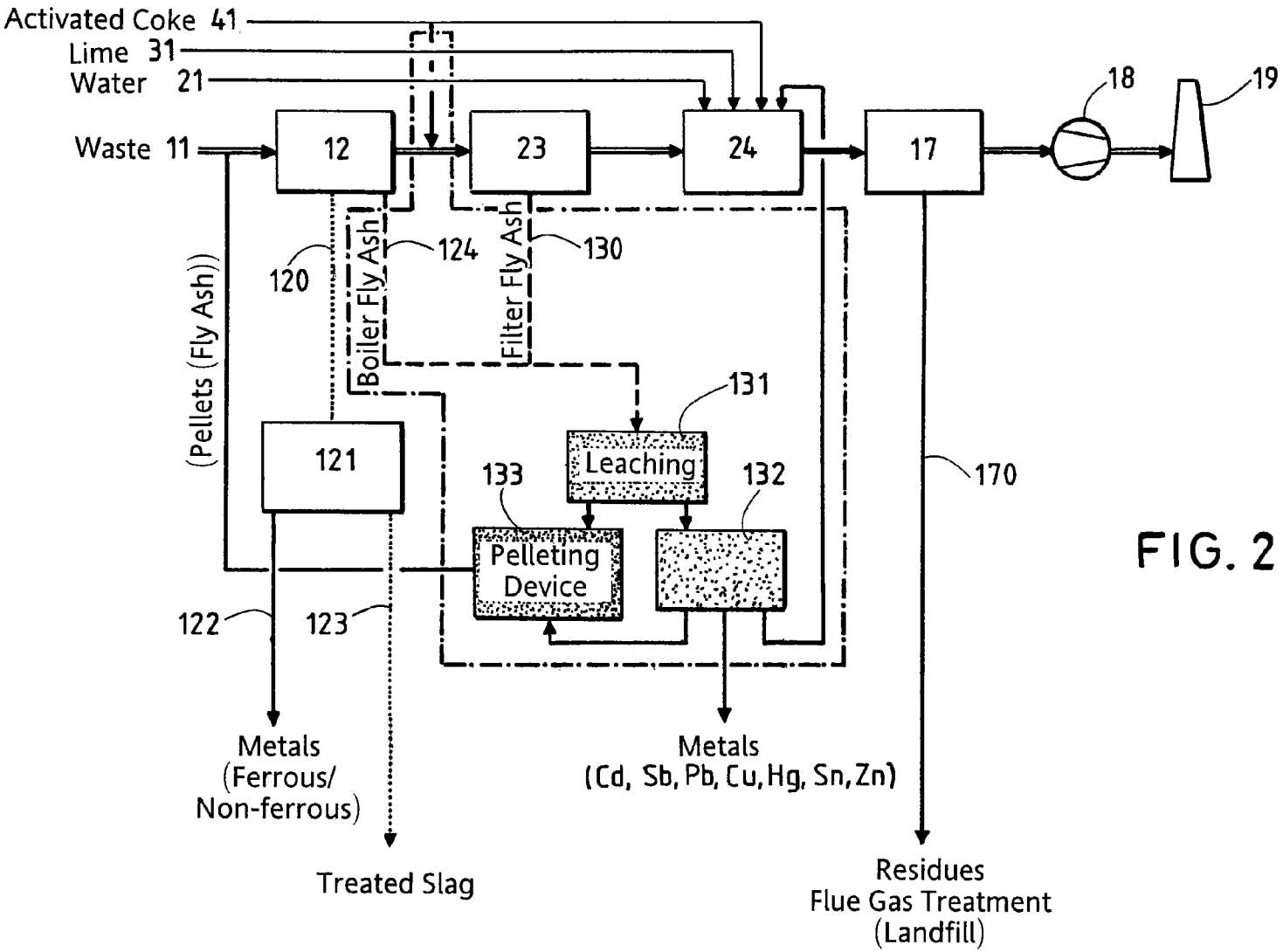
FIG. 2 schematically a further embodiment of a process scheme of a waste incineration plant.

FIG. 2 is another schematic process diagram of a waste incineration plant. In this case, the waste incineration plant is equipped with a dry, respectively, semi-dry flue gas treatment system, whereby the flue gases exiting the combustion chamber 12 are at first conveyed to an electrostatic precipitator 23. Upstream of the entry of the flue gases into the electrostatic precipitator 23, activated coke is added.

By utilizing the electrostatic precipitator 23, fly ash 130 containing mineral compounds and metal compounds, in particular compounds of heavy metals, is separated thereby. Subsequently, the hot flue gas is conveyed from the electrostatic precipitator 23 to a spray-absorber 24, wherein lime 31 and activated carbon as well as water 21 is added into the spray absorber 24. Hereby the flue gas, exiting the spray-absorber 24, is cooled, whereby the acid contaminants such as hydrogen chloride (HCl), hydrogen fluoride (HF), and sulphur oxides ($SO_X$) react with lime, whereby solid particulate reaction products result.

Subsequently the flue gas, loaded with the reaction products, fly ash as well as activated coke and surplus hydrate of lime, is conveyed to the filter device 17 with a bag house, whereby the residues 170 that have to be disposed are separated. Hereafter, the cleaned flue gas is emitted via the downstream draft fan 18 and the stack 19 into the atmosphere.

The boiler fly ash 124, discharged from the combustion chamber 12, and the filter fly ash 130, discharged from the electrostatic precipitator 23, are conveyed as fly dust or fly ash to the leaching device 131 for leaching of the fly ash.

Thereby the metals, respectively, heavy metals contained in the fly ash are conveyed to the metal extraction device 132 to recover the appropriate metals for re-use. The other discharged products from the extraction stage 132 are conveyed to the pelleting device 133 as well as the spray-absorber 24.

In the leaching device 131 in particular ammonia or acids are used as leaching fluids so that consecutively in the metal extraction device 132 during the extraction process the metals, solved in the leaching fluid, are extracted and recycled for re-use. The residues, produced in the leaching process, and the fly ashes or filter fly ashes, reduced by their metal, respectively, heavy metal parts, are pelletized with their mineral fractions in the pelleting device 133, whereby the mineral pellets are returned to the combustion chamber 12 to be incorporated in newly formed bottom ash.

In the process example shown in FIG. 2 the fly ash, consisting of boiler fly ash and filter fly ash, is leached with hydrochloric acid and/or with an aqueous solution of ammonia, whereby the salts from in the metal extraction are added to the residues of the flue gas treatment.

According to the invention, boiler fly ash and filter fly ash of waste incineration facilities are treated in such a way as to recycle the mineral fractions of filter fly ash, respectively, boiler fly ash by returning them into the combustion chamber 12 so that the mineral components are incorporated into newly formed bottom ash.

Simultaneously the highly volatile metals, contained in the filter fly ash and boiler fly ash, are recovered and conveyed to appropriate metallurgical plants for re-use. In particular, two process steps are performed in the waste incineration plants, whereby at first the fly dusts, respectively, the boiler fly ash as well as the filter fly ash are leached with hydrochloric acid and/or with an aqueous ammonia solution for the reduction of the metal content and the salt content, whereby after consecutive drying and pelleting of the mineral fractions of the boiler fly ash respectively filter fly ash, the fly ash, reduced by metals contained, are added dosed to the waste 11 to be incinerated.

Furthermore, the metals leached from the fly ash are recovered in the extraction device 132 out of the leaching fluid by extraction steps, which include in embodiments stripping, extraction and precipitation. The re-usable metals, recovered in the extraction device 132, are in particular arsenic (As), antimony (Sb), cadmium (Cd), copper (Cu), lead (Pb), mercury (Hg), tin (Sn) and zinc (Zn).

Especially the amount of hazardous wastes resulting from the operation of the incineration plant is reduced to about 1 weight % to 2 weight % depending on the amount of fly ash in relation to the treated, respectively, incinerated amount of waste, whereby the hazardous wastes are conveyed to an appropriate landfill.

A further advantage of the method is that the process steps can be integrated into existing waste incineration facilities according to the state of the art without producing new residues which require novel ways or means of disposal.

All named characteristics, including those taken from the drawings alone, and individual characteristics, which are disclosed in combination with other characteristics, are considered alone and in combination as important to the invention. Embodiments according to the invention can be fulfilled through individual characteristics or a combination of several characteristics.

LIST OF REFERENCE NUMBERS

11 Waste
12 Combustion Chamber
13 Filter Device
14 Heat Exchanger
15 HCl-Wet Scrubber
16 Sulphur Dioxide Scrubber
17 Filter Device
18 Draft Fan
19 Stack
21 Water
23 Electrostatic Precipitator
24 Spray Dry Absorber
31 Lime
41 Active Coke
120 Bottom Ash
121 Bottom Ash Treatment
122 Metals (Ferrous/Non-Ferrous)
123 Treated Bottom Ash (Mixture of Minerals)
124 Boiler Fly Ash
130 Filter Fly Ash
131 Leaching Device
132 Extraction Device
133 Pelleting Device
134 Intermediate Reservoir
150 Hydrochloric Acid
151 Rectification Device
152 Residues
153 Hydrochloric Acid
160 Sulphur Dioxide
161 Gypsum Processing Device

The invention claimed is:

1. Method for the treatment of fly ash from a combustion process in a waste incineration plant of municipal solid waste, comprising the steps of:

fly ash is separated from a combustion process of municipal solid waste, metals and/or metal containing compounds are separated from the fly ash, which is non-fractioned, wherein the non-fractioned fly ash, in the metals and/or metal containing compounds separation step, is treated by a wet chemical leaching process, so that the fly ash is reduced by metals and/or metal containing compounds and/or earth alkaline metals, and subsequently the fly ash, reduced by the metals and/or metal containing compounds is dosed, mixed with or added to the waste to be incinerated in the waste incineration process so that the mineral parts of the fly ash, reduced by its metals and/or metals containing compounds, are returned to the combustion process.

2. Method according to claim 1, wherein the fly ash, reduced by its metals and/or metal containing compounds is pelleted, in predetermined quantities, in a pelleting device.

3. Method according to claim 2, wherein the compacted fly ash, reduced by its metals and/or metal containing compounds, and formed into pellets, is stored in an intermediate reservoir as fly ash residue.

4. Method according to claim 1, wherein the wet chemical leaching process is leaching extraction.

5. Method according to claim 4, wherein in the metals and/or metals containing compounds separation step, the concentration of the heavy metals or heavy metal containing compounds in the fly ash is reduced by at least 50%, through the leaching process.

6. Method according to claim 4, wherein the heavy metals or heavy metal containing compounds contained in the fly ash are extracted after the leaching step by means of a leaching solvent in an extraction step and/or, are precipitated in a solvent extraction process.

7. Method according to claim 4, wherein the mineral fractions containing residue of the leaching process is returned to the incineration process.

8. Method according to claim 4, wherein the fly ash is treated by means of ammonia alkaline leaching and/or by means of hydrochloric leaching.

9. Method according to claim 1, wherein the amount of residues resulting from the incineration process that has to be disposed is reduced by 1.5 weight % and more of the amount of waste to be incinerated according to the mineral fractions of the fly ash.

10. Method according to claim 1, wherein filter fly ash and/or boiler fly ash from flue gases of the waste incineration processes are subjected as non-fractioned fly ash to the separation step.

11. Method for the operation of a waste incineration plant for municipal solid waste or the like, whereby the method steps are performed according to claim 1.

12. The method of claim 1, wherein the metals and/or metal containing compounds are heavy metals and/or heavy metal containing compounds.

13. The method of claim 2, wherein the fly ash is dewatered.

14. The method of claim 3, wherein the intermediately stored, fly ash residue from the intermediate reservoir is mixed with or added to the waste to be incinerated.

* * * * *